US009934767B2

(12) United States Patent
Sumner et al.

(10) Patent No.: US 9,934,767 B2
(45) Date of Patent: Apr. 3, 2018

(54) ANTERIOR LOAD CARRIAGE STABILITY AND MOBILITY SUPPORT SYSTEM

(71) Applicant: AUBURN UNIVERSITY, Auburn, AL (US)

(72) Inventors: Andrea Michelle Sumner, Fayetteville, NC (US); Wendi Weimar, Auburn, AL (US); Sara Elizabeth Wolf, Auburn, AL (US)

(73) Assignee: AUBURN UNIVERSITY, Auburn, AL (US)

( * ) Notice: Subject to any disclaimer, the term of this patent is extended or adjusted under 35 U.S.C. 154(b) by 0 days.

(21) Appl. No.: 15/252,724

(22) Filed: Aug. 31, 2016

(65) Prior Publication Data

US 2016/0372093 A1 Dec. 22, 2016

Related U.S. Application Data

(63) Continuation of application No. 14/079,780, filed on Nov. 14, 2013, now Pat. No. 9,437,175.

(Continued)

(51) Int. Cl.
*G10D 13/02* (2006.01)
*G10D 13/00* (2006.01)

(Continued)

(52) U.S. Cl.
CPC ..... *G10D 13/026* (2013.01); *A45F 3/10* (2013.01); *G10D 13/00* (2013.01); *G10G 5/005* (2013.01)

(58) Field of Classification Search
CPC ..... G10D 13/026; G10D 13/00; G10G 5/005
See application file for complete search history.

(56) References Cited

U.S. PATENT DOCUMENTS

D903,682 11/1908 Cumpston
D909,217 1/1909 Presba (Continued)

OTHER PUBLICATIONS

Yusuf S.S.M. Al-Khabbaz, Tomoaki Shimada, Masashi Hasegawa, The effect of backpack heaviness on trunk-lower extremity muscle activities and trunk posture, Gait & Posture 28, 2008, pp. 297-302, Elsevier.

(Continued)

*Primary Examiner* — Robert W Horn
(74) *Attorney, Agent, or Firm* — Gardner Groff Greenwald & Villanueva, PC

(57) ABSTRACT

The present invention relates generally to the field of an anterior load carriage stability and mobility support system, and more particularly to marching band equipment and marching drum stability and mobility support belt for a marching drummer in K-12 primary or secondary, a collegiate, a drum and bugle corps or the like. A device capable of providing a support mechanism for the lumbar region of a user's back that allows for load distribution from loads placed anteriorly and inferiorly to the drummer's body. A preferred embodiment of the device includes a large piece and two smaller pieces of neoprene fabric, dual straps sewn along the sides of the belt, removable commercial grade closed cell foam sheets, and two plastic tubing for a sturdy structure with flexibility and versatility, and Velcro® sewn along the straps and on the obverse side of the belt for easy and secure attachment of the straps.

19 Claims, 5 Drawing Sheets

Related U.S. Application Data

(60) Provisional application No. 61/726,266, filed on Nov. 14, 2012.

(51) Int. Cl.
*G10G 5/00* (2006.01)
*A45F 3/10* (2006.01)

(56) References Cited

U.S. PATENT DOCUMENTS 2,008,201 A 7/1935 Chute
2,250,267 A * 7/1941 Lins ..... A61F 5/028 128/845
2,484,383 A 10/1949 Lee
2,973,030 A * 2/1961 Matthewson ..... A61F 5/055 128/DIG. 23
3,102,446 A * 9/1963 Raleigh ..... G10G 5/005 224/271
3,204,650 A * 9/1965 Shinew ..... A45B 11/02 135/16
3,307,535 A 3/1967 Locke
3,322,312 A * 5/1967 Mitchell ..... A45F 3/08 224/635
4,074,839 A 2/1978 Wood et al.
4,256,007 A * 3/1981 Streit ..... G10G 5/005 224/910
4,384,372 A 5/1983 Rector
4,402,441 A 9/1983 Jones et al.
4,438,763 A * 3/1984 Zablen ..... A45F 3/14 128/845
4,453,442 A 6/1984 LaFlame
4,483,070 A * 11/1984 Junkermann ..... A01G 3/08 224/185
4,605,144 A 8/1986 LaFlame
4,627,109 A * 12/1986 Carabelli ..... A61F 5/028 2/300
4,634,032 A 1/1987 LaFlame
4,644,654 A * 2/1987 Howe ..... A01G 3/053 224/262
4,715,293 A 12/1987 Cobbs
4,796,315 A 1/1989 Crew
4,976,387 A 12/1990 Spianti
5,060,836 A * 10/1991 Bradford ..... A45F 5/00 224/271
5,076,131 A * 12/1991 Patterson ..... G10H 1/32 84/412
5,179,942 A 1/1993 Drulias et al.
5,195,948 A * 3/1993 Hill ..... A61F 5/028 602/19
5,199,940 A * 4/1993 Morris ..... A61F 5/055 128/845
D352,114 S 11/1994 Nicholson
5,388,274 A 2/1995 Glover et al.
5,400,683 A 3/1995 LaFlame
5,464,137 A 11/1995 Shirdavani
5,493,941 A 2/1996 Verge
5,551,085 A 9/1996 Leighton
5,690,609 A 11/1997 Heinze, III
D388,246 S 12/1997 Patterson
5,836,489 A * 11/1998 Swetish ..... A45F 3/10 224/262
5,941,436 A 8/1999 Washington et al.
5,984,885 A 11/1999 Gaylord, Jr. et al.
D418,948 S * 1/2000 London ..... D24/190
6,137,675 A 10/2000 Perkins
D435,611 S * 12/2000 Hines ..... D2/627
6,155,764 A 12/2000 Russo
6,364,186 B1 4/2002 Gilmour et al.
6,481,108 B1 11/2002 Helinski
6,619,521 B2 9/2003 Hadley
6,748,615 B1 6/2004 Tiedemann
6,755,799 B2 6/2004 Toda
7,009,097 B1 3/2006 Terplivetz
7,378,584 B2 5/2008 Frank et al.
7,495,163 B1 * 2/2009 Goodrich ..... G10G 5/005 224/270
D595,859 S 7/2009 Young
7,671,261 B1 * 3/2010 Momose ..... G10G 5/005 84/421
7,709,714 B2 * 5/2010 Harbaugh ..... G10G 5/005 224/264
D625,019 S 10/2010 Chiang
7,865,975 B2 1/2011 Davies et al.
8,026,433 B2 * 9/2011 Place ..... G10G 5/005 224/910
8,066,654 B2 11/2011 Sandifer et al.
8,353,434 B2 1/2013 Clayton, III et al.
8,658,876 B2 * 2/2014 Momose ..... G10G 5/005 84/421
9,093,054 B2 7/2015 Verges
9,437,175 B2 * 9/2016 Sumner ..... G10G 5/005
9,754,568 B2 * 9/2017 May ..... G10G 5/005
2002/0125278 A1 9/2002 Wagmild
2011/0082403 A1 4/2011 Hill
2011/0108597 A1 5/2011 Kunow et al.
2013/0133505 A1 * 5/2013 Momose ..... G10G 5/005 84/421
2016/0372093 A1 * 12/2016 Sumner ..... G10G 5/005
2017/0092244 A1 * 3/2017 Shigenaga ..... A45F 3/10

OTHER PUBLICATIONS

A. M. Anderson, K. A. Meador, L. R. McClure, D. Makrozahopoulos, D. J. Brooks, G. A. Mirka. A biomechanical analysis of anterior load carriage, Ergonomics, Nov. 21, 2007, 50:12, pp. 2104-2117, Taylor & Francis, London.

Renee L. Attwells, Stewart A. Birrell, Robin H. Hooper, Neil J. Mansfield, Influence of carrying heavy loads on soldiers' posture, movements and gait, Ergonomics, Feb. 20, 2007, 49:14, pp. 1527-1537, Taylor & Francis, London.

S. A. Birrell, R. A. Haslam, The influence of rifle carriage on the kinetics of human gait, Ergonomics, May 16, 2008, 51:6, pp. 816-826, Taylor & Francis, London.

Stewart A. Birrell, Roger A. Haslam, Ergonomics, The effect of military load carriage on 3-D lower limb kinematics and spatiotemporal parameters, Oct. 21, 2010, 52:10, pp. 1298-1304, Taylor & Francis, London.

Stewart A. Birrell, Roger A. Haslam, The effect of load distribution within military load carriage systems on the kinetics of human gait, Applied Ergonomics 41, 2010, pp. 585-590, Elsevier.

Stewart A. Birrell, Robin H. Hooper, Roger A. Haslam, The effect of military load on ground reaction forces, Gait & Posture 26, 2007, pp. 611-614, Elsevier.

David Bloom, Ann P. Woodhull-McNeal, Postural adjustments while standing with two types of loaded backpack, pp. 1425-1430.

J. Bobet, R. W. Norman, Effects of load placement on back muscle activity in load carriage, European Journal of Applied Physiology, 1984, 53: pp. 71-75, Springer-Verlag.

Thomas M. Cook, Donald A. Neumann, The effect of load placement on the EMG activity of the low back muscles during load carrying by men and women, Ergonomics, 1987, pp. 1413-1423, 30.

Christa Devroey, Ilse Jonkers, An De Becker, Gerlinde Lenaertsm Arthur Spaepen, Evaluation of the effect of backpack load and position during standing and walking using biomechanical, physiological and subjective measures, Ergonomics, Aug. 29, 2007, 50:5, pp. 728-742, Taylor & Francis, London.

J.T. Bryant, J.B. Doan, J.M. Stevenson, R.P. Pelot, S.A. Reid, Validation of Objective Based Measures and Development of a Performance-Based Ranking Method for Load Carriage Systems, 2000.

Theresa Foti, Ph.D, Jon R. Davis, M.D., Anita Bagley, Ph.D, A Biomechanical Analysis of Gait During Pregnancy, May 2000, pp. 625-632, 82-A, The Journal of Bone and Joint Surgery.

J-H Goh, A Thambyah, K Bose, Effects of varying backpack loads on peak forces in the lumbosacral spine during walking, Clinical Biomechanics, 1998, pp. S26-S31, Elsevier, Great Britain.

(56) References Cited

OTHER PUBLICATIONS

Lucas A. Snipes, Henry A. Foley, M.D., Bruce H. Heckman, M.D., James A. Rock, M.D., John D. Goodson, M.D., Joseph M. Connors, M.D., Sandford A. Marcus, M.D., James Michelson, Brachial plexus injury from tight backpack straps, The New England Journal of Medicine, Aug. 27, 1981.
Karen Grimmer, Breton Dansie, Steve Milanese, Ubon Pirunsan, Patricia Trott, Adolescent standing postural response to backpack loads: a randomised controlled experimental study, BMC Musculoskeletal Disorders, 2002, Grimmer.
Ki-Noon Han, Everett Harman, Peter Frykman, Michael Johnson, Franklin Russell, Michael Rosenstein, Load Carriage: The Effects of Walking Speed on Gait Timing, Kinetics, and Muscle Activity, p. 773, U.S. Army Research Institute of Environmental Medicine.
Everett A. Harman, Peter N. Frykman, Joseph J. Knapik Facsm, Ki-Noon Han, Backpack vs. Front-back pack: Differential effects of load on walking posture, p. 785, E-34 Slide Biomechanics: Gait II.
Everett Harman, Ki-Hoon Han, Peter Frykman, Michael Johnson, Franklin Russell, Michael Rosenstein, The effects of gait timing, kinetics, and muscle activity of various loads carried on the back, p. 774.
M.A. Holbeinm M.S. Redfern, Functional stability limits while holding loads in various positions, 1997, International Journal of Industrial Ergonomics, Elsevier, pp. 387-396.
Michael Holewijn, Physiological strain due to load carrying, European Journal of Applied and Occupational Physiology, Feb. 1990, Research Gate.
Kenneth G. Holt, Robert C. Wagenaar, Michael E. Lafiandra, Masayoshi Kubo, John P. Obusek, Increased musculoskeletal stiffness during load carriage at increasing speeds maintains constant vertical excursion of the body center of mass, Journal of Biomechanics 36, 2003, pp. 465-471, Elsevier.
Youlian Hong, Jing Xian Li, Influence of load and carrying methods on gait phase and ground reactions in children's stair walking, Gait & Posture 22, 2005, pp. 63-68, Elsevier.
Youlian Hong, Jing-Xian Li, Daniel Tik-Pui Fong, Effect of prolonged walking with backpack loads on trunk muscle activity and fatigue in children, Journal of Electromyography and Kinesiology 18, 2008, pp. 990-996, Elsevier.
Tafazzul Husain, An experimental study of some pressure effects on tissues with reference to the bed-sore problem, pp. 347.
Hiroshi Kinoshita, Effects of different loads and carrying systems on selected biomechanical parameters describing walking gait, Ergonomics, 19985, 1347-1362, vol. 28.
Joseph Knapik, Everett Harman, Katy Reynolds, Load carriage using packs: A review of physiological, biomechanical and medical aspects, Applied Ergonomics, pp. 207-216, Elsevier.
Joseph J. Knapik, Katy L. Reynolds, Everett Harman, Solider Load Carriage: Historical, Physiological, Biomechanical and Medical Aspects, Military Medicine, 2004.
M. Lafiandra, R.C. Wagenaar, K.G. Holt, J.P. Obusek, How do load carriage and walking speed influence trunk coordination and stride parameters?, Journal of Biomechanics 36, 2003, pp. 87-95, Elsevier.
Tzu-Hsien Lee, Yung-Hui Lee, An investigation of stability limits while holding a load, Ergonomics, Nov. 9, 2010, Taylor & Francis.
S.J. Legg, A. Mahanty, Comparison of five modes of carrying a load close to the trunk, Ergonomics, 1985, pp. 1653-1660.
Wen Ling, Vern Houston, Yung-Sheng Tsai, Kevin Chui, John Kirk, Women's Load Carriage Performance Using Modular Lightweight Load-Carrying Equipment, Military Medicine, 2004.
Hamish W. Mackie, Joan M. Stevenson, Susan A. Reid, Stephen J. Legg, The effect of simulated school load carriage configurations on shoulder strap tension forces and shoulder interface pressure, Applied Ergonomics 36, 2005, pp. 119-206, Elsevier.
M.S. Malhotra, J. Sen Gupta, Carrying of School Bags by Children.
Rue Ancelle, Soldier Mobility: Inventions in Load Carriage System Design and Evaluation, 2000, Research and Technology Organization.
Philip E. Martin, Richard C. Nelson, The effect of carried loads on the walking patterns of men and women, 1986, vol. 29, pp. 1191-1202, Ergonomics.
Michael J. Moore, Gregory L. White, Donna L. Moore, Association of Relative Backpack Weight With Reported Pain, Pain Sites, Medical Utilization, and Lost School Time in Children and Adolescents, Journal of School Health, May 2007.
R.E.E. Motmans, S. Tomlow, D. Vissers, Trunk muscle activity in different modes of carrying schoolbags, Ergonomics, Feb. 20, 2007, Taylor & Francis, London.
Rohae Myung, James L. Smith, The effect of load carrying and floor contaminants on slip and fall parameters, Ergonomics, Nov. 9, 2010, Taylor & Francis, London.
David D. Pascoe, Donna E. Pascoe, Yong Tai Wang, Dong-Ming Shim, Chang K. Kim, Influence of carrying book bags on gait cycle and posture of youths, Ergonomics, Nov. 10, 2010, Taylor & Francis, London.
Xingda Qu, Maury A. Nussbaum, Effects of external loads on balance control during upright stance: Experimental results and model-based predictions, Gait and Posture 29, 2009, pp. 23-30, Elsevier.
SA Reid, JM Stevenson, RA Whiteside, Biomechanical assessment of lateral stiffness elements in the suspension system of a backpack, Ergonomics, Feb. 20, 2007, Taylor & Francis, London.
Bruce J. Sangeorzan, Richard M. Harrington, Craig R. Wyss, Joseph M. Czerniecki, Frederick A. Matsen III, Circulatory and Mechanical Response of Skin to Loading, Journal of Orthopaedic Research, 1989, pp. 425-431, Raven Press, New York.
Jeffrey M. Schiffman, Carolyn K. Bensel, Leif Hasselquist, Karen N. Gregorczyk, Louis Piscitelle, Effects of carried weight on random motion and traditional measures of postural way, Applied Ergonomics 37, 2006, pp. 607-614, Elsevier.
F. Scribano, M. Burns, E.R. Barron, Design, Developments and Fabrication of a Personnel Armor Load Profile Analyzer, United States Army Natick Laboratories, Apr. 1970, Clothing and Personal Life Support Equipment Laboratory, Massachusetts.
Yasin B. Seven, N. Ekin Akalan, Can A. Yucesoy, Effects of back loading on the biomechanics of sit-to-stand motion in healthy children, Human Movement Science 27, 2008, pp. 65-79, Elsevier.
S.R. Sharpe, K.G. Holt, E Saltzman, R.C. Wagenaar, Effects of a hip belt on transverse plane trunk coordination and stability during load carriage, Journal of Biomechanics 41, 2008, pp. 968-976, Elsevier.
Barbara Smith, Kelly M. Ashton, Danielle Bohl, Richard C. Clark, J. Brooke Metheny, Stephanie Klassen, Influence of carrying a backpack on pelvic tilt, rotation, and obliquity in female college students, Gait & Posture 23, 2006, pp. 263-267, Elsevier.
Stephanie A. Southard, Gary A. Mirka, An evaluation of backpack harness systems in non-neutral torso postures, Applied Ergonomics 38, 2007, pp. 541-547, Elsevier.
Yong Tai Wang, D.D. Pascoe, W. Weimar, Evaluation of book backpack load during walking, Ergonomics, Taylor & Francis, London.
Rakie Cham, Mark S. Redfern, Gait adaptations during load carrying on level and inclined surfaces, Occupational Ergonomics 4, 2004, pp. 11-26, IOS Press.
Michael Lafiandra, Everett Harman, The Distribution of Forces between the Upper and Lower Back during Load Carriage, Official Journal of the American College of Sports Medicine, 2004, pp. 460-467.
David D. Pasco, Donna E. Pascoe, Bookbags Help to Shoulder the Burdens of School Work, Human Kinetics, Mar. 1999, pp. 18-20.

* cited by examiner

ANTERIOR LOAD CARRIAGE STABILITY AND MOBILITY SUPPORT SYSTEM

CROSS-REFERENCE TO RELATED APPLICATION

This Application is a continuation of U.S. Non-Provisional patent application Ser. No. 14/079,780 filed Nov. 14, 2013, which claims priority to and benefit under 35 U.S.C. § 119(e) to U.S. Provisional Patent Application Ser. No. 61/726,266 filed Nov. 14, 2012, the contents of which are incorporated herein by reference in their entireties.

STATEMENT REGARDING FEDERALLY SPONSORED RESEARCH

Not Applicable.

TECHNICAL FIELD OF THE INVENTION

The present invention relates generally to the field of load carriage support systems, and more particularly to marching bands and equipment and to a marching drum stability and mobility support belt.

BACKGROUND OF THE INVENTION

Each year thousands of students participate in marching bands. Many participate by carrying a flag, baton, woodwind or brass instrument, or a percussion instrument, i.e., drum. These musicians perform demanding and strenuous movements, and a particular group of musicians perform these movements while carrying large cumbersome loads. The drumline is of particular interest due to the unique and restricting nature of the instrument: a load carried anterior to the body with the only points of contact on the body at the shoulders and across the abdominal area. The influence of load carriage research on gait and joint mechanics, muscle activity, and contact pressure can be seen in the ever changing backpack designs and recommendations of load mass; however, there still remains a lack of research on marching band load carriage.

Many load carriage professions and recreational activities utilize a lumbar belt as part of the lift belt, hiking pack, or military rucksack to help dissipate the weight of the load between the shoulders, trunk, and pelvis. This background knowledge of the environments in which lumbar belts are already being used is what began the initial thought of how to utilize this load carriage tool for the marching band members, particularly since their load carriage situations are similar and yet so unique. The existing technology is fairly consistent across the industries: military, hiking, ergonomics. The belt is either form-fitting or stuffed with a small amount of padding, cut to lie in the small of the back. Some designs will wrap around the sides of the trunk and over the pelvic bones, but either the padding does not continue around the body or the connection of the belt is at the abdominal region which would interfere with the drum carrier's belly or abdominal plate. The general attachment techniques include using Velcro® to attach the two side pieces to each other, or using a buckle that will snap across the abdomen.

The predominate use of these lumbar belts is for loads that are being carried on the back part of the body. Thus, it can be seen that needs exist for improved marching drum stability and mobility support belt that allows for load distribution from loads placed on the front of the body.

At this time, however, it can be seen that the concept of using a belt that will connect to a drum carrier has been established prior to this invention's disclosure. The prior art utilizes a belt designed to attach via a buckle and/or Velcro® connectors to a drum carrier. Such a device has been disclosed in, for example, U.S. patent application Ser. No. 13/305,068 and U.S. Pat. No. 7,671,261.

Momose, however, did not teach the use of a belt for back support in U.S. Pat. No. 7,671,261, but, rather, only for the purpose of bringing the drum closer to the user's body via a fixed positioning and guiding path of the belt. However, there are still many differences between the prior art and the present invention, as the features of the present invention will become more fully apparent from the following description and appended claims, or may be learned by the practice of the invention as set forth hereinafter.

BRIEF SUMMARY OF THE INVENTION

In example embodiments, the present invention provides an anterior load carriage stability and mobility support system.

The present concept embodiments are directed to a marching drum stability and mobility support belt used by a drummer in a K-12 primary or secondary education or collegiate marching band, as well as professional drum and bugle corps or the like. This includes, but is not limited to, those individuals who march snare drums, tenor drums, bass drums or the like. The drumline is of particular interest due to the unique and restricting nature of the instrument: a load carried anterior to the body with the only points of contact on the body at the shoulders and across the abdominal area. The influence of load carriage research on gait and joint mechanics, muscle activity, and contact pressure can be seen in the ever changing backpack designs and recommendations of load mass; however, there still remains a lack of research on marching band load carriage.

The marching drum stability and mobility support belt has a plurality of unique characteristics from the prior art including the neoprene fabric, which is able to withstand the perspiration from the marchers and can be washed for continued use.

The present invention further comprises at least one strap that is sewn along the edges on the side of the support belt, allowing for strength and security when the marching drummers pull on the at least one strap to tighten the support belt.

In addition, another unique characteristic of the present invention is the variable placement, flexibility, and versatility of being able to attach the support belt to any location on the drum carrier. More specifically, the present invention is capable of reversibly fastening the at least one strap of the support belt to a plurality of points on the drum carriage apparatus via Velcro®, a buckle, a clasp or the like, according to needs of the individual marching drummer and also where the line of pull of the at least one strap is based on the location of the drum to the body of the user.

The present invention may further comprise the unique characteristic of the at least one sheet of commercial grade yet affordable closed cell foam that not only absorbs some of the weight off of the drum system but also provides support to the lower back of the marching drummers, and, consequently, provides comfort to the marching drummers. The at least one sheet of closed cell foam is also cut to fit the dimensions of each support belt based on the size determined by each individual marching drummer's respective measurements.

Another unique characteristic of the present invention is the at least one removable plastic tubing that provides a sturdy structure to the support belt, which has the flexibility of curving around and following the contour of the individual marching drummer's back area.

The present invention still further comprises the unique characteristic of the Velcro® sewn along the at least one strap and on the obverse side of the support belt for easy and secure attachment of the at least one strap, in addition to being able to have the at least one strap lie flush against the body versus a buckle that could potentially create a hot spot against the marching drummer's body.

These features and advantages of the invention will become more fully apparent from the following description and appended claims of the preferred embodiments thereof, or may be learned by the practice of the invention as set forth hereinafter.

BRIEF DESCRIPTION OF THE DRAWINGS

A more complete understanding of the present invention and benefits thereof may be acquired by referring to the following description taken in conjunction with the accompanying drawings, in which.

DETAILED DESCRIPTION OF THE INVENTION

As has been mentioned, the present description of the invention is about a load carriage support system, and more particularly to marching bands and equipment and to a marching drum stability and mobility support belt made for the marching drummer.

The apparatus of the present invention is the result of the inventors' discovery that developing a marching drum mobility and stability belt that provides support and comfort for the drummer can significantly enhance the performance of the marching drummer, drumline, and overall marching band or drum corps. The present inventors further provide improvements over the lumbar belts on the market by providing a marching drum stability and mobility support belt that is more comfortable for the drummer with a potential decrease in the occurrence of an injury, and anecdotally providing relief to the participants while standing, walking, or marching.

Reference throughout this specification may be expressed herein, including in the claims, as the terms "back", "lower back", or "lumbar region" when applied to the support belt area disclosed herein, meaning that the device is capable of providing support for the posterior musculature of the user's trunk and pelvis including, but not limited to, the erector spinae.

Similarly, as used in the specification including the appended claims, the terms "belly" or "abdominal region" when applied to the support belt area disclosed herein, meaning that the device is capable of providing a more efficient demand of the anterior musculature of the user including, but not limited to, the abdomen or the pelvis.

Additionally, as used in the specification including the appended claims, the singular forms "a," "an," and "the" include the plural, and reference to a particular numerical value includes at least that particular value, unless the context clearly dictates otherwise.

Detailed descriptions of the preferred embodiment are provided herein. It is to be understood, however, that the present invention may be embodied in various forms. The specific details disclosed herein are not to be interpreted as limiting, but, rather, as a basis of illustrating the general principles of the invention. Although the exemplary implementations are described below in the context of a marching drum stability and mobility support belt, it is to be further understood that the present invention may be embodied in various fields including, but not limited to, patient assistance, patient transport, general load carrying or the like. The present invention can further be applicable to other fields including those yet to be developed.

Embodiments of the present invention are now described in more detail.

Figure 1:
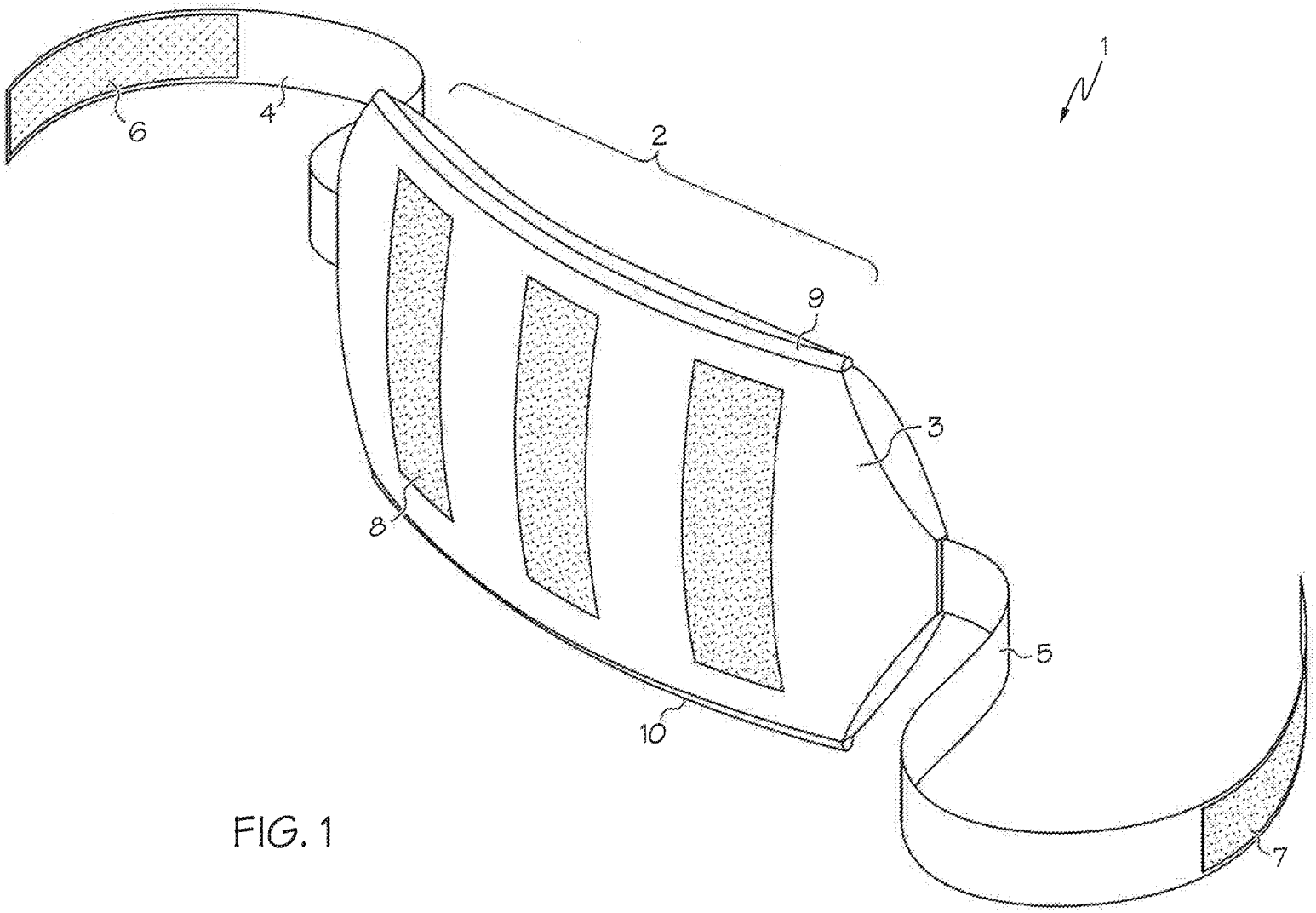
FIG. 1 shows an elevational perspective view of the obverse side of a marching drum stability and mobility support belt in the open position according to an example embodiment of the present invention.

Referring now to FIG. 1, an elevational perspective view of the obverse side of a marching drum stability and mobility support belt 1 in the open position according to an example embodiment of the present invention. The support belt 1 comprises a support mechanism 2 with the capability of providing support for the posterior musculature of a user's back. The support mechanism 2 can further provide a more efficient demand of the anterior musculature of the user. The support mechanism 2 can still further provide comfort for the user by reducing the amount of contact pressure at the shoulders by redistributing those pressures to the abdominal region and pelvis.

In the preferred embodiment of the invention, the marching drum stability and mobility support belt 1 comprises a left side strap 4 and a right side strap 5 capable of attaching at the edges of the support belt 1 by sewing with heavy-duty thread. The two straps 4, 5 comprising a left side Velcro® attachment 6 and a right side Velcro® attachment 7 on each strap by sewing with heavy-duty thread. The materials of the two straps 4, 5 are nylon and polyester.

The marching drum stability and mobility support belt 1 further comprises a top removable plastic tubing 9 and a bottom removable plastic tubing 10 for a sturdy and flexible support structure. The material of the two removable plastic tubing 9, 10 is polyethylene. The marching drum stability and mobility support belt 1 can further comprise the outside Velcro® attachments 8 on the one large piece layer of neoprene 3 on the obverse side of the support belt 1 by sewing with heavy-duty thread.

Figure 2:
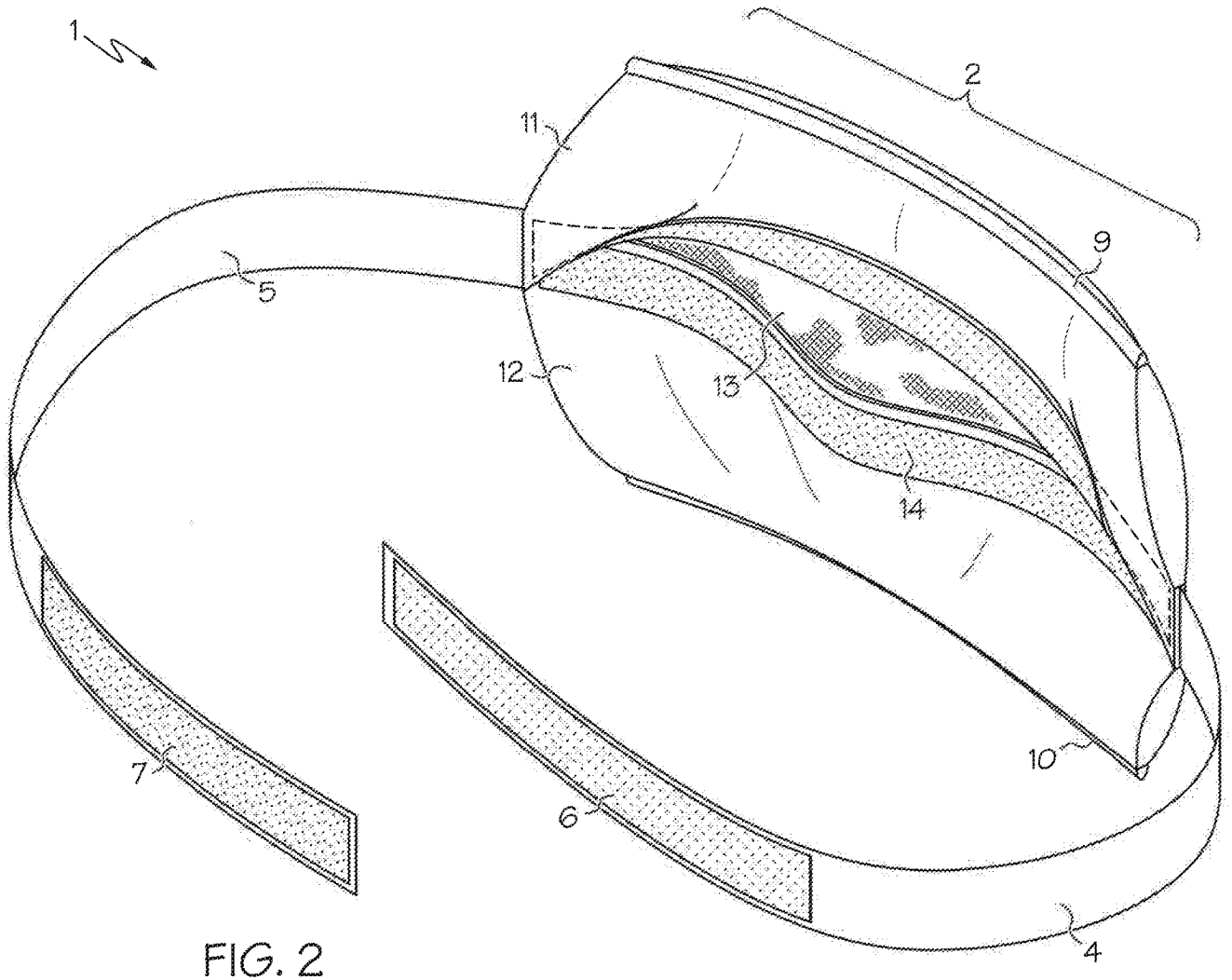
FIG. 2 shows an elevational perspective view of the inverse side of a marching drum stability and mobility support belt in the open position according to an example embodiment of the present invention shown in FIG. 1, wherein the two separate layers of neoprene are detached from the Velcro® strip, showing the enclosed two removable commercial grade closed cell foam sheets.

FIG. 2 shows an elevational perspective view of the inverse side of a marching drum stability and mobility support belt in the open position according to an example embodiment of the present invention shown in FIG. 1. The support belt 1 comprises a support mechanism 2 with the capability of providing support for the posterior musculature of a user's back. The support mechanism 2 can further provide a more efficient demand of the anterior musculature of the user. The support mechanism 2 can still further provide comfort for the user by reducing the amount of contact pressure at the shoulders by redistributing those pressures to the abdominal region and pelvis.

In the preferred embodiment of the invention, the marching drum stability and mobility support belt 1 comprises a left side strap 4 and a right side strap 5 capable of attaching at the edges of the support belt 1 by sewing with heavy-duty thread. The two straps 4, 5 comprising a left side Velcro® attachment 6 and a right side Velcro® attachment 7 on each strap by sewing with heavy-duty thread. The materials of the two straps 4, 5 are nylon and polyester.

The support belt 1 further comprises two smaller detachable separate overlapping layers of neoprene at the top 11 and at the bottom 12 of the inverse side, enclosing two removable commercial grade closed cell foam sheets 13. The two commercial grade dosed cell foam sheets 13 can be removed to allow the support belt 1 to be cleaned.

The two detachable separate overlapping layers of neoprene at the top 11 and bottom 12 of the inverse side are capable of connecting by a strip of Velcro® attachment 14. The marching drum stability and mobility support belt 1 further comprises a top removable plastic tubing 9 and a bottom removable plastic tubing 10 for a sturdy and rigid support structure with the flexibility to lie along the curvature of the user's back. The material of the two removable plastic tubing 9, 10 is polyethylene.

Figure 3:
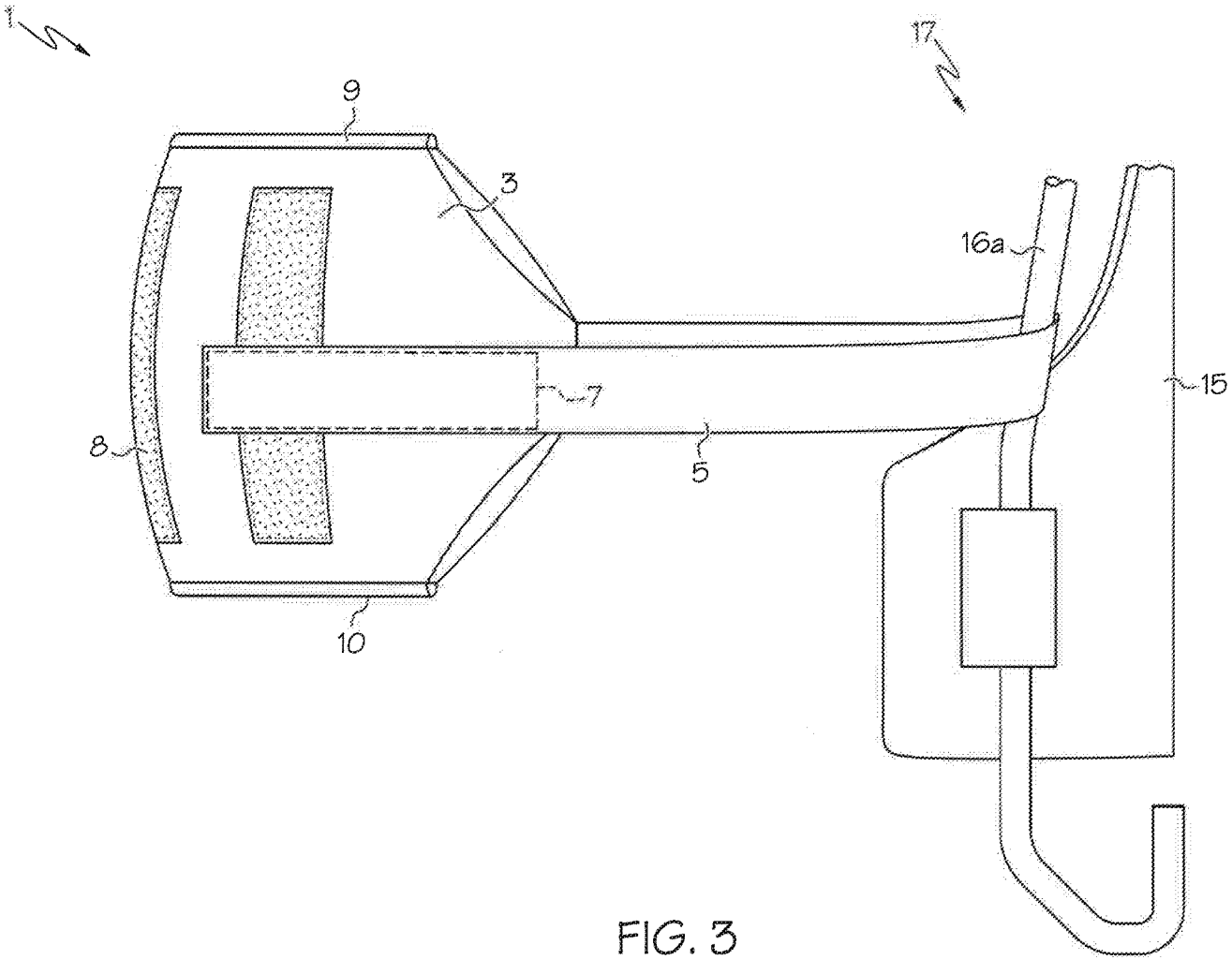
FIG. 3 shows an enlarged fragmented side elevational perspective view of a marching drum stability and mobility support belt with the right side strap in the fastened position, attaching and fastening via Velcro® by looping around the J-rod of a marching drum carriage apparatus.

FIG. 3 is an enlarged fragmented side elevational perspective view of a marching drum stability and mobility support belt 1 in the fastened position attaching via the right side strap Velcro® attachment 7 around a marching drum carriage apparatus 17. The support belt 1 of the present invention is capable of attaching to a plurality of points on the marching drum carriage apparatus 17.

The plurality of points on the marching drum carriage apparatus 17 can be of multiple areas including, but not limited to, the J-rods 16*a*, the tubular members 16*b*, T-bar or the like. As shown, the present area of interest on the marching drum carriage apparatus 17 is the J-rod 16*a*, which is connected to the abdominal plate 15 of the apparatus 17.

The right side strap 5 is extending from the marching drum stability and mobility support belt 1 and fastened by looping around the J-rod 16*a* of the marching drum carriage apparatus 17 and connecting back onto the support belt 1 and onto the outside Velcro® attachment 8 on the one large piece layer of neoprene 3 on the obverse side of the support belt 1.

The marching drum stability and mobility support belt 1 still further comprises a top removable plastic tube 9 and a bottom removable plastic tube 10 for a sturdy and rigid support structure with the flexibility to lie along the curvature of the user's back. The material of the two removable plastic tubing 9, 10 is polyethylene.

Figure 4:
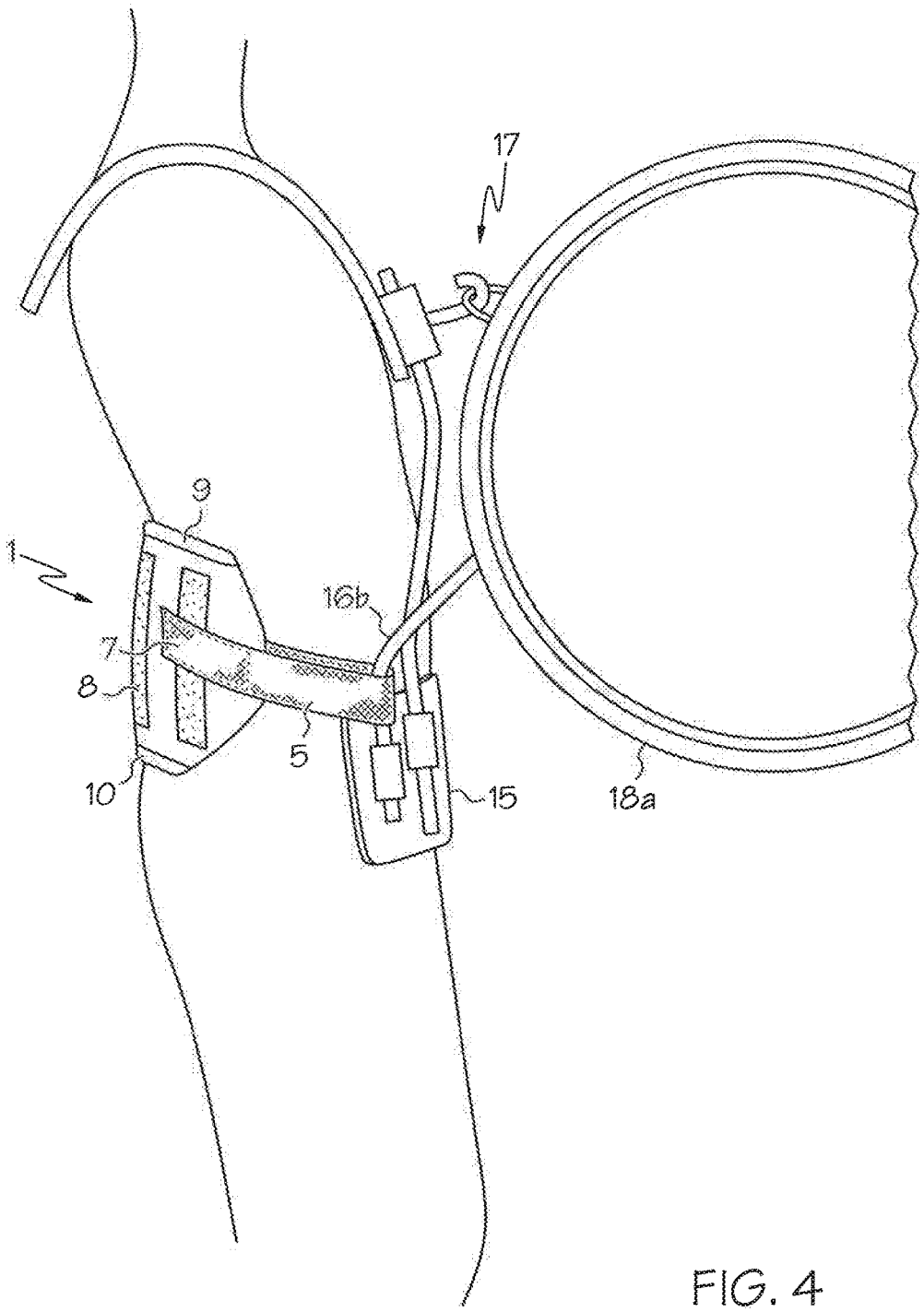
FIG. 4 shows a side perspective view of a marching drum stability and mobility support belt with the right side strap in the fastened position, attaching and fastening via Velcro® by looping around the tubular member of a marching drum carriage apparatus worn by a marching drummer or user according to an example embodiment of the present invention.

FIG. 4 shows a side perspective view of a marching drum stability and mobility support belt 1 in the fastened position attaching via the right side strap Velcro® attachment 7 to a marching drum carriage apparatus 17 worn by a marching drummer or user according to an example embodiment of the present invention. The support belt 1 of the present invention is capable of attaching to a plurality of points on a marching drum carriage apparatus 17.

The plurality of points on the marching drum carriage apparatus 17 can be of multiple areas including, but not limited to, the J-rods 16*a*, the tubular members 16*b*, T-bar or the like. As shown, the present area of interest on the marching drum carriage apparatus 17 is the tubular member 16*b*, which is connected to the abdominal plate 15 of the apparatus 17.

The right side strap 5 is extending from the marching drum stability and mobility support belt 1 and fastened by looping around the tubular member 16*b* of the marching drum carriage apparatus 17 and connecting back onto the support belt 1 via the outside Velcro® attachment 8 on the obverse side of the support belt 1.

The marching drum carriage apparatus 17 is a marching drum carrier capable of attaching to and supporting a plurality of drums including, but not limited to, a snare drum 18*b*, tenor drum, bass drum 18*a* or the like. As shown, the support belt 1 is fastened to a marching drum carrier worn by the drummer around the tubular member 16*b*, and the drum carrier is attaching to and supporting a bass drum 18*a*.

The marching drum stability and mobility support belt 1 further comprises a top removable plastic tube 9 and a bottom removable plastic tube 10 for a sturdy and flexible support structure. The material of the two removable plastic tubing 9, 10 is polyethylene.

Figure 5:
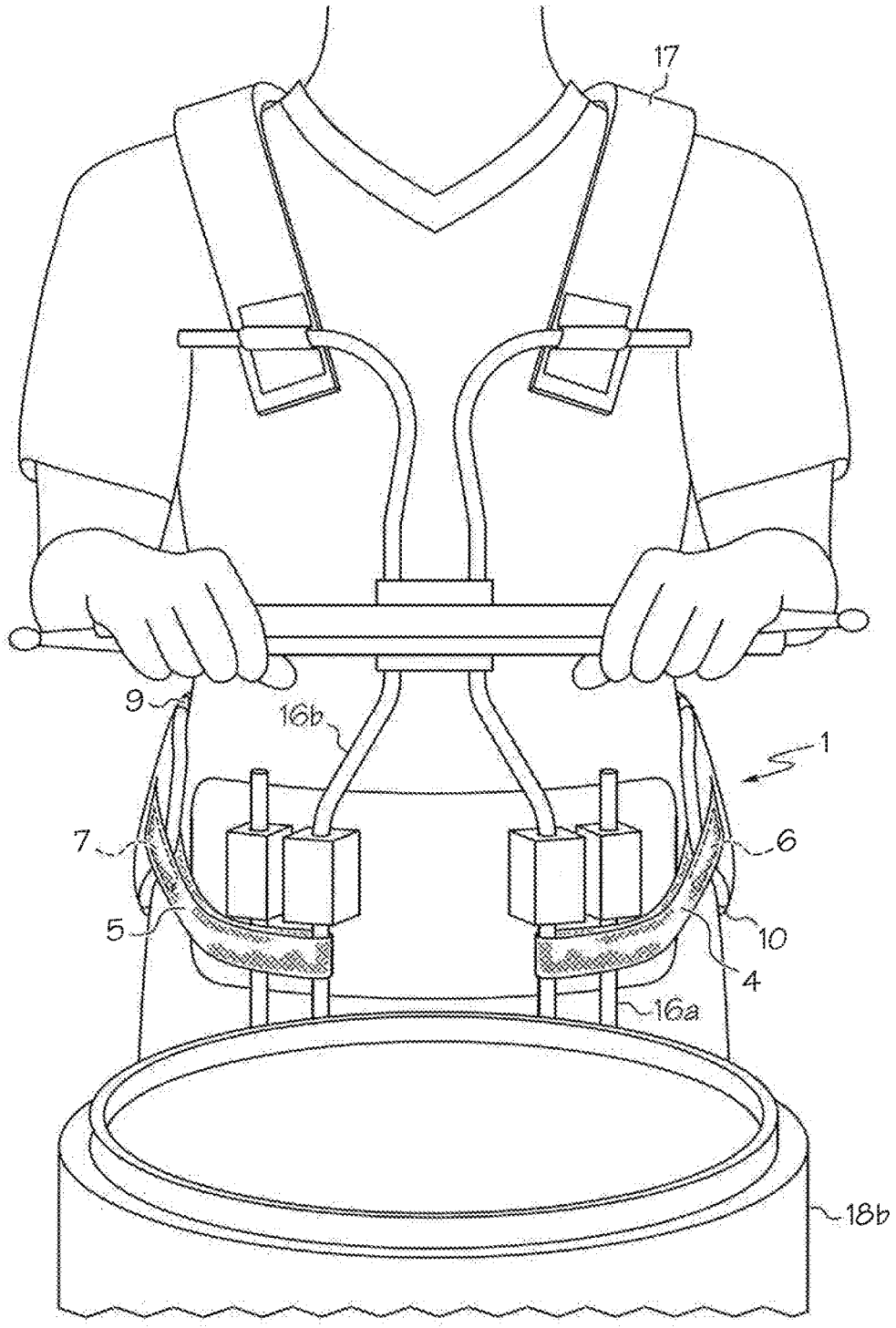
FIG. 5 shows a front perspective view of a marching drum stability and mobility support belt with the left side and right side straps in the fastened position, attaching and fastening via Velcro® by looping around the tubular members of a marching drum carriage apparatus worn by a marching drummer or user according to an example embodiment of the present invention.

FIG. 5 shows a front perspective view of a marching drum stability and mobility support belt 1 in the fastened position attaching via Velcro® to a marching drum carrier worn by a marching drummer or user according to an example embodiment of the present invention. The left side strap 4 and the right side strap 5 are extending from the marching drum stability and mobility support belt 1 and fastening around the plurality of points on the marching drum carriage apparatus 17 and connecting back onto the obverse side of the support belt 1.

The plurality of points on the marching drum carriage apparatus 17 can be of multiple areas including, but not limited to, the J-rods 16*a*, the tubular members 16*b*, T-bar or the like. As shown, the present areas of interest on the marching drum carriage apparatus 17 are the tubular members 16*b*, which are connected to the abdominal plate 15 of the apparatus 17.

The marching drum carriage apparatus 17 is a marching drum carrier capable of attaching to and supporting a plurality of drums including, but not limited to, a snare drum 18*b*, tenor drum, bass drum 18*a* or the like. As shown, the support belt 1 is fastened to a marching drum carrier worn by the drummer around the tubular members 16*b*, and the drum carrier is attaching to and supporting a snare drum 18*b*.

The marching drum stability and mobility support belt 1 further comprises a top removable plastic tube 9 and a bottom removable plastic tube 10 for a sturdy and flexible support structure. The material of the two removable plastic tubing 9, 10 is polyethylene.

While at least one exemplary embodiment of the present invention has been presented in the foregoing detailed description, it should be appreciated that a vast number of variations exist. The specific embodiments as disclosed and illustrated herein are not to be considered in a limiting sense. It should be apparent and understood to persons skilled in the art that what is presented herein may be modified in numerous ways. It is only indicated by the appending claims, including all equivalents, which are intended to define the scope of this invention.

What is claimed is:

1. An anterior load carriage stability and mobility support system for a load carriage apparatus to be worn by a user and for contacting the shoulders and abdominal area thereof, the anterior load carriage stability and mobility support system comprising:

a support mechanism for placement against the user's back, the support mechanism comprising at least one piece of fabric defining an area comprising a length defined between ends of the at least one piece of fabric and a width defined between sides of the at least one piece of fabric;

straps coupled to the ends of the support mechanism for coupling the support mechanism to the load carriage apparatus, wherein tension applied to the straps causes a substantially even distribution of the tension being applied amongst the entire area of the support mechanism between the ends and the sides; and at least one plastic tubing member mounted to one or both sides of the support mechanism and extending between the ends.

2. The anterior load carriage stability and mobility support system according to claim 1, wherein an end of a first strap is coupled to a first end of the support mechanism at a midpoint defined between the sides of the support mechanism, and wherein an end of a second strap is coupled to a second end of the support mechanism at a midpoint defined between the sides of the support mechanism.

3. The anterior load carriage stability and mobility support system according to claim 2, wherein the end of the first strap is coupled to the first end of the support mechanism and wherein the end of the second strap is coupled to the second end of the support mechanism.

4. The anterior load carriage stability and mobility support system according to claim 1, further comprising at least one sheet of closed cell foam positioned against the at least one piece of fabric.

5. The anterior load carriage stability and mobility support system according to claim 4, wherein with the support mechanism's even distribution of the tension applied thereto by the straps, the at least one sheet of closed cell foam provides support for the posterior musculature of the user's lumbar region and pelvis.

6. The anterior load carriage stability and mobility support system according to claim 1, wherein the at least one plastic tubing member provides for a sturdy and rigid support structure and is flexible to follow the curvature of a user's back.

7. The anterior load carriage stability and mobility support system according to claim 1, wherein the length defined between the ends of the support mechanism is substantially sufficient for at least partially wrapping around a user's sides.

8. The anterior load carriage stability and mobility support system according to claim 1, wherein the support mechanism provides support for the posterior musculature of the user's lumbar region and pelvis.

9. The anterior load carriage stability and mobility support system according to claim 1, wherein the straps are generally looped through at least a portion of the load carriage and removably secured back to themselves or to a portion of the support mechanism, and wherein the straps are tightened sufficiently such that the support mechanism is positioned properly against the user's back for supporting the posterior musculature of the user's lumbar region and pelvis.

10. The anterior load carriage stability and mobility support system according to claim 9, wherein the straps are removably secured to themselves or to a portion of the support mechanism by one or more fasteners including a hook-and-loop fastener, a buckle, or a clasp.

11. The anterior load carriage stability and mobility support system according to claim 10, wherein the straps are capable of at least looping around one or more portions of the load carriage including one or more J rods, tubular members, and/or a T bar.

12. The anterior load carriage stability and mobility support system according to claim 1, wherein the support mechanism comprises at least two pieces of fabric joined about an outer periphery thereof, the at least two pieces of fabric defining an area comprising a length defined between ends of the at least two pieces of fabric and a width defined between sides of the at least two pieces of fabric.

13. The anterior load carriage stability and mobility support system according to claim 12, further comprising at least one sheet of closed cell foam positioned against at least one of the at least two pieces of fabric, and wherein the at least one sheet of closed cell foam is removable from between the two pieces of fabric.

14. A marching band instrument support assembly comprising:

a carriage comprising a pair of shoulder supports, an abdominal plate, a first pair of support members coupling the shoulder supports to the abdominal plate, and a second pair of support members connected to the abdominal plate and configured for removably coupling to an instrument;

a support belt comprising a support mechanism configured for placement against the lumbar region of a user's back and the straps configured for removably coupling to at least one of the first and second support members, the support mechanism generally comprising at least one piece of fabric defining an area comprising a length defined between ends of the at least one piece of fabric and a width defined between sides of the at least one piece of fabric;

straps coupled to the ends of the support mechanism for coupling the support mechanism to the load carriage apparatus, wherein tension applied to the straps causes an even distribution of the tension being applied amongst the entire area of the support mechanism between the ends and the sides; and at least one plastic tubing member mounted to one or both sides of the support mechanism and extending between the ends, wherein the at least one plastic tubing member provides for a sturdy and rigid support structure and is flexible to follow the curvature of a user's back.

15. The marching band instrument support assembly of claim 14, wherein the straps are coupled to the ends of the at least one piece of fabric, and wherein the straps are generally looped through at least a portion of the carriage and secured back to themselves or to a portion of the support mechanism, and wherein the straps are adjustable to control positioning of the support belt against the user's lumbar region and pelvis.

16. The marching band instrument support assembly of claim 14, further comprising at least one sheet of closed cell foam positioned against the at least one piece of fabric of the support mechanism.

17. The marching band instrument support assembly of claim 16, wherein the support mechanism in combination with the at least one sheet of closed cell foam reduces the amount of contact pressure of the shoulder supports at the shoulders of the user.

18. The marching band instrument support assembly of claim 17, wherein the contact pressure of the shoulder supports is redistributed to the abdominal region and pelvis of the user.

19. An anterior load carriage stability and mobility support system for a load carriage apparatus to be worn by a user and for contacting the shoulders and abdominal area thereof, the anterior load carriage stability and mobility support system comprising:

a support mechanism for placement against the user's back, the support mechanism comprising three pieces of material defining an area comprising a length defined between ends of the at least one piece of material and a width defined between sides of the at least one piece of material;

straps coupled to the ends of the support mechanism for coupling the support mechanism to the load carriage apparatus, wherein tension applied to the straps causes a substantially even distribution of the tension being applied amongst the entire area of the support mechanism between the ends and the sides; and at least one plastic tubing member mounted to one or both sides of the support mechanism and extending between the ends, wherein the at least one plastic tubing member provides for a sturdy and rigid support structure and is flexible to follow the curvature of a user's back.

* * * * *